US008807423B2

(12) United States Patent
Cha et al.

(10) Patent No.: US 8,807,423 B2
(45) Date of Patent: Aug. 19, 2014

(54) AUTOMATIC TELLER MACHINE

(75) Inventors: Jin Hwan Cha, Seoul (KR); Won Joon Lee, Seoul (KR); Dong Sik Lee, Seoul (KR)

(73) Assignee: Nautilus Hyosung Inc., Seoul (KR)

( * ) Notice: Subject to any disclaimer, the term of this patent is extended or adjusted under 35 U.S.C. 154(b) by 158 days.

(21) Appl. No.: 13/519,121

(22) PCT Filed: Dec. 31, 2010

(86) PCT No.: PCT/KR2010/009617

§ 371 (c)(1),
(2), (4) Date: Jun. 25, 2012

(87) PCT Pub. No.: WO2011/081497

PCT Pub. Date: Jul. 7, 2011

(65) Prior Publication Data

US 2012/0280034 A1 Nov. 8, 2012

(30) Foreign Application Priority Data

Dec. 31, 2009 (KR) ..... 10-2009-0136052
Dec. 31, 2009 (KR) ..... 10-2009-0136176

(51) Int. Cl.
*G07F 19/00* (2006.01)

(52) U.S. Cl.
USPC ..... 235/379; 235/383

(58) Field of Classification Search
USPC ..... 235/379, 380, 383; 194/206, 207; 902/8, 9, 11, 12, 13, 14, 15
See application file for complete search history.

(56) References Cited

U.S. PATENT DOCUMENTS

| | | | | |
|---|---|---|---|---|
| 4,146,220 | A * | 3/1979 | Barton | 271/233 |
| 4,542,287 | A * | 9/1985 | Watanabe | 235/379 |
| 4,726,474 | A * | 2/1988 | Arikawa et al. | 209/534 |
| 5,240,368 | A * | 8/1993 | Graef et al. | 414/788.9 |
| 8,181,764 | B2 * | 5/2012 | Cha et al. | 194/206 |
| 2009/0160127 | A1 | 6/2009 | Kong et al. | |

FOREIGN PATENT DOCUMENTS

| | | | |
|---|---|---|---|
| KR | 20-0392317 | Y1 | 8/2005 |
| KR | 10-2007-0052048 | A | 5/2007 |
| KR | 10-2007-0055082 | A | 5/2007 |
| KR | 10-2009-0072666 | A | 7/2009 |

OTHER PUBLICATIONS

PCT International Search Report and Written Opinion, PCT/KR2010/009617, Sep. 27, 2011, 11 pages.

* cited by examiner

*Primary Examiner* — Daniel St Cyr
(74) *Attorney, Agent, or Firm* — Fenwick & West LLP

(57) ABSTRACT

An automatic teller machine (ATM) may temporarily stack paper mediums in a carriage, adjust an advancing direction of the carriage by rotating the carriage by a rotor, and dispense the paper mediums to one of a plurality of dispenser portions by the carriage moving along movement paths. In addition, since a discharge path for paper medium being discharged from a rejected medium transfer portion to a collected medium storage portion and a discharge path for paper medium being discharged from the carriage to the collected medium storage portion are formed in a common discharge space, paper mediums detected to be abnormal and rejected and paper mediums not received by the dispenser portions but retracted may be stored in one place. Consequently, the structure may be simplified.

15 Claims, 12 Drawing Sheets

AUTOMATIC TELLER MACHINE

TECHNICAL FIELD

The present invention relates to an automatic teller machine (ATM), and more particularly, to an ATM capable of reducing a jam of paper mediums, simplifying an inner structure and a money withdrawal operation, and collecting a rejected paper medium and a retracted paper medium during transfer along a medium transfer unit in one space.

BACKGROUND ART

Generally, an automatic teller machine (ATM) refers to an automated apparatus providing fundamental monetary services, such as payment and withdrawal of cash and check, using a card or a bankbook regardless of time and places without a bank teller. Recently, use of the ATM is not limited to banking facilities such as banks but expanded to convenience stores, department stores, and other public places.

The ATM may be classified into a cash dispenser, a cash receiver, and a cash dispenser and receiver. In these days, the ATM is used for not only payment and withdrawal of cash but also payment and withdrawal of check, bankbook arrangement, fee payment by giro, ticketing, and the like.

Inside the ATM, a medium transfer path is formed for transfer of a paper medium such as cash, checks, tickets, merchandise coupons, and the like. Generally, the medium transfer path includes combination of rollers and belts. The medium transfer path is very complicated in structure and control. Also, the entire size of the medium transfer path is large. Therefore, increase in the transfer path for the paper mediums is limited. In addition, a paper jam frequently occurs in a transfer unit.

In a conventional ATM, when wrong transfer of a paper medium is detected, a rejected paper medium is stored in a rejected medium storage unit and, separately, a paper medium not received by a dispenser portion but retracted is stored in a retracted medium storage unit.

However, when the rejected medium storage unit and the retracted medium storage unit are separated, the overall structure of the ATM becomes complicated and the entire size is increased, accordingly requiring a larger installation space. Moreover, cost is increased.

Accordingly, there is a demand for an ATM simplified in structure to store the rejected paper medium and the retracted paper medium in one space, thereby reducing the cost and the installation space.

DISCLOSURE OF INVENTION

Technical Goals

An aspect of the present invention provides an automatic teller machine (ATM) capable of simplifying a medium transfer path for transferring a paper medium, and conveniently dispensing paper mediums in a bundle to a dispenser portion.

Another aspect of the present invention provides an ATM capable of dispensing paper mediums quickly and easily by directly transferring a carriage, on which paper mediums are temporarily stacked, to the dispenser portion.

Another aspect of the present invention provides an ATM capable of easily converting a carriage advancing direction by rotating a rotor in which the carriage is inserted, and conveniently transferring the carriage to any one of a plurality of dispenser portions.

Another aspect of the present invention provides an ATM simplified in the structure by collecting, in one space, a paper medium detected to be abnormal during transfer and determined to be rejected and a paper medium not received by the dispenser portion but retracted.

Another aspect of the present invention provides an ATM structured such that a storage portion to store the rejected paper medium and a storage portion to store the retracted paper medium are integrated, thereby reducing the entire size and also reducing cost.

Technical Solutions

According to an aspect of the present invention, there is provided an automatic teller machine (ATM) including a case in which a plurality of dispenser portions are disposed in different positions, a medium storage unit provided to the case to store paper mediums, a medium transfer unit to transfer the paper mediums sheet by sheet from the medium storage unit, a medium inspection unit provided to the medium transfer unit to detect the paper mediums being transferred by the medium transfer unit, a carriage in which paper mediums determined to be normal by the medium inspection unit are stacked, the carriage configured to be transferred along any one of movement paths connected to the plurality of dispenser portions to dispense the paper mediums through any one of the plurality of dispenser portions, a rotor in which the carriage is withdrawably inserted, the rotor rotatably mounted in the case and rotated along with the carriage in any position between a first position in which the paper mediums are stacked in the carriage and a second position in which the carriage is moved to the movement paths, and a medium collection unit disposed in the case such that paper mediums determined to be abnormal by the medium inspection unit are collected along a path bypassing the carriage and the rotor.

That is, paper mediums determined to be normal by the medium inspection unit may be stacked in the carriage. A withdrawal direction of the carriage may be adjusted to any one of the movement paths by the rotor. Along the movement paths, the carriage may be moved to any one of the dispenser portions. The paper mediums in the carriage may be dispensed through the dispenser portions.

The paper mediums determined to be abnormal may be collected in real time by the medium collection unit. Therefore, a dedicated operation mode for collecting the paper medium determined to be abnormal by the medium inspection unit is unnecessary. Also, an operation for stacking the paper mediums in the carriage may be continuously performed without interference with the abnormal paper mediums.

A plurality of the medium storage units may be provided at the case. The medium transfer unit may selectively transfer the paper medium stored in any one of the medium storage units.

The plurality of dispenser portions may include a front dispenser portion disposed on a front portion of the case, a rear dispenser disposed at a rear portion of the case, and an upper dispenser disposed at an upper surface of the case. The movement paths may include a front movement path disposed between the front dispenser and the rotor, a rear movement path disposed between the rear dispenser and the rotor, and an upper movement path disposed between the upper dispenser and the rotor. However, not limited thereto, the number of the dispenser portions and the movement paths may be varied according to the design and conditions of the ATM.

The movement paths each include guide rails disposed on opposite lateral sides of the case to guide a movement direction of the carriage, and rail gears arranged in a length direction of the guide rails, and the carriage may include guide rollers disposed on opposite lateral sides to be moved along the guide rails, respectively, and moving gears disposed on the opposite lateral sides of the carriage to be engaged with and moved along the rail gears, respectively. Accordingly, the carriage may be stably supported by the guide roller and the moving gear, and moved along the rail gears by the moving gear.

The carriage may include a first carriage portion provided with the guide rollers and the moving gears disposed on the opposite lateral sides, and rotated along with the rotor when the rotor rotates, a second carriage portion disposed to face the first carriage portion such that the paper mediums are disposed between the first carriage portion and the second carriage portion, and a carriage driving portion to which the first carriage portion and the second carriage portion are foldably connected, the carriage driving portion configured to drive the moving gear.

The first carriage portion may include a first transfer belt brought into tight contact with one surface of the paper mediums, the second carriage portion may include a second transfer belt brought into tight contact with the other surface of the paper mediums, and the first transfer belt and the second transfer belt may be driven by the carriage driving portion. Therefore, when the first transfer belt and the second transfer belt are driven in a folded state by the carriage driving portion, the paper mediums disposed between the first carriage portion and the second carriage portion may be withdrawn out of the carriage.

The carriage driving portion may include a first carriage driving portion connected to the moving gear to drive the moving gear, and a second carriage driving portion connected to the first transfer belt and the second transfer belt to drive the first transfer belt and the second transfer belt.

The carriage driving portion may be connected to a controller of the ATM in various manners. Operations of the first carriage portion and the second carriage portion may be properly controlled by the controller. Various methods may be used to connect the carriage driving portion and the controller according to the design and conditions. For example, the carriage driving portion may be connected to the controller by an elongated cable or elastic cable, or by electrifiable contact parts between the guide rails and the guide roller.

The first carriage portion and the second carriage portion may be moved away from each other, thereby forming a stacking space to stack the paper mediums, when the rotor is disposed in the first position. The first carriage portion and the second carriage portion may be folded to each other, thereby fixing the paper mediums stacked in the stacking space, when the rotor is disposed in other than the first position. That is, when the first carriage portion and the second carriage portion are separated, the paper mediums may be stacked in the stacking space. When the first carriage portion and the second carriage portion are folded, the paper mediums stacked in the stacking space may be stably supported.

The second carriage portion may include an opening projection configured to be interfered with the case or the medium transfer unit such that the first carriage portion and the second carriage portion are separated from each other when the rotor rotates to the first position, thereby restricting rotation of the second carriage portion.

The rotor may include rotation portions rotatably disposed on opposite lateral sides of the case so as to support movement of opposite lateral sides of the carriage, and a connecting portion of which opposite sides are connected to the rotation portions and in which the carriage is mounted.

The medium collection unit may include a reject box to receive the paper mediums determined to be abnormal by the medium inspection unit, and a reject transfer portion including a path bypassing the rotor and the carriage between the reject box and the medium transfer unit and transferring the paper mediums to the reject box. Accordingly, the paper mediums determined to be abnormal by the medium inspection unit may be not stacked in the carriage but collected in the reject box along the reject transfer portion. The operation of the medium transfer unit may not be stopped during this, and stacking of the paper mediums in the carriage may be continued.

The ATM may further include a retract box to store paper mediums collected from the dispenser portions when the paper mediums dispensed to the dispenser portions are not received.

An entrance of the retract box may be directed to the rotor. Therefore, when the rotor rotates the carriage toward the entrance of the retract box, the carriage may be moved to the entrance of the retract box and insert the paper mediums into the retract box.

The ATM may further include a main driving portion disposed in the case to supply a driving force to the medium transfer unit and the medium collection unit.

According to another aspect of the present invention, there is provided an ATM including a rejected medium transfer portion connected to a medium transfer unit that transfers paper mediums from a medium storage unit that stores the paper mediums, so as to transfer a rejected paper medium which is detected to be abnormal during transfer of the paper mediums along the medium transfer unit and determined to be rejected, a carrier position adjustment portion to adjust a position of a medium carrier that carries a retracted paper medium which is not received but retracted during dispensing of the paper mediums, and a collected medium storage portion disposed at a rear end of the rejected medium transfer portion to store the rejected paper medium or disposed within a movement range of the medium carrier to store the retracted paper medium, wherein a discharge path for a paper medium discharged from the rejected medium transfer portion to the collected medium storage portion and a discharge path for a paper medium discharged from the medium carrier to the collected medium storage portion are disposed in a common discharge space.

According to the above structure, a paper medium detected to be abnormal during transfer along the medium transfer portion and determined to be rejected, and a paper medium not received by the dispenser portions but retracted may be collected in one space, thereby simplifying the overall structure.

The ATM may further include a direction guide portion disposed at a rear end of the rejected medium transfer portion disposed adjacent to the common discharge space to be rotatable in an up and down direction, so as to selectively guide an advancing direction of the paper mediums. The direction guide portion may transfer the paper mediums transferred by the rejected medium transfer portion to the collected medium storage portion, or transfer the paper mediums transferred by the medium carrier to the collected medium storage portion. Accordingly, the rejected or refracted paper mediums may be transferred to the collected medium storage portion without escaping.

The direction guide portion may include a guide body and a rotational axis for axially rotating the guide body, and the guide body may be direction-converted by a pressing force of the paper mediums approaching the guide body.

The carrier position adjustment portion may include a carrier guide disposed between an entrance of the collected medium storage portion and the carrier position adjustment portion so that the medium carrier approaches the entrance when the paper mediums are retracted.

A rotation roller unit may be mounted at an entrance area of the collected medium storage portion to introduce the paper mediums to an inner space of the collected medium storage portion.

The rotation roller unit may include an upper roller portion including a rotational axis axially rotated by a driving source and a plurality of rollers arranged in a length direction of the rotational axis, and a lower roller portion including a rotational axis rotated in an opposite direction to rotation of the rotational axis of the upper roller portion and a plurality of rollers arranged in a length direction of the rotational axis of the lower roller portion, and wherein the pluralities of rollers may be made of an elastic material elastically deformable in an inward direction. Accordingly, the plurality of paper mediums may be passed through the rotation roller unit and introduced into the collected medium storage portion.

The entrance area of the collected medium storage portion may include a rotation guide freely rotated according to an advancing direction of the paper mediums to guide the paper mediums discharged from the rejected medium transfer portion or the medium carrier into the rotation roller unit. Therefore, the rejected or retracted paper medium may be stably transferred to the collected medium storage portion without escaping.

Effects of Invention

In an automatic teller machine (ATM) according to an embodiment of the present invention, a structure for transferring paper mediums may be simplified since the paper mediums are transferred in a bundle directly by a carriage to a dispenser portion. In addition, a jam of paper mediums generated during transfer of the paper mediums may be reduced, thereby preventing reduction in efficiency of the ATM.

According to an embodiment of the present invention, the ATM is structured in such a manner that a carriage in which paper mediums are stacked is directly transferred to a plurality of dispenser portions along movement paths of a case. Therefore, control of a dispensing operation of the ATM may be simplified, and a dispensing time for the paper mediums may be reduced. That is, the dispensing operation for the paper mediums may be quickly performed.

In the ATM according to an embodiment of the present invention, since the carriage is transferred to a plurality of dispenser portions along the movement paths, the paper mediums may be dispensed to several positions of the ATM. Also, the ATM may be applied in various environments.

In the ATM according to an embodiment of the present invention, an advancing direction of a carriage is conveniently adjusted by a rotor. Therefore, the carriage may be conveniently disposed at any one of a medium transfer unit, dispenser portions, and a retract box. Thus, since the movement paths of the carriage are conveniently selected and converted by rotation of the rotor, operation of the ATM may be simplified, consequently facilitating control of the ATM.

In the ATM according to an embodiment of the present invention, paper mediums are transferred to the carriage or a medium collection unit according to a detection value of a medium inspection unit. That is, normal paper mediums may be transferred to the carriage while abnormal paper mediums are transferred to the medium collection unit.

Therefore, while the paper mediums are being normally stacked in the carriage by the medium transfer unit, paper mediums determined to be abnormal by the medium inspection unit may be collected to the medium collection unit before being stacked in the carriage. Thus, a dedicated operation mode for collecting abnormal paper mediums is unnecessary. As a result, the operational efficiency of the ATM may be maximized.

In addition, the ATM according to an embodiment of the present invention collects a paper medium detected to be abnormal during transfer and determined to be rejected and a paper medium not received by the dispenser portion but retracted, in one space. Accordingly, the overall structure of the ATM may be simplified.

In the ATM according to an embodiment of the present invention, a storage unit to store the rejected paper medium and a storage unit to store the retracted paper medium are integrated, thereby reducing the entire size and also reducing cost.

BEST MODE FOR CARRYING OUT THE INVENTION

Figure 1:
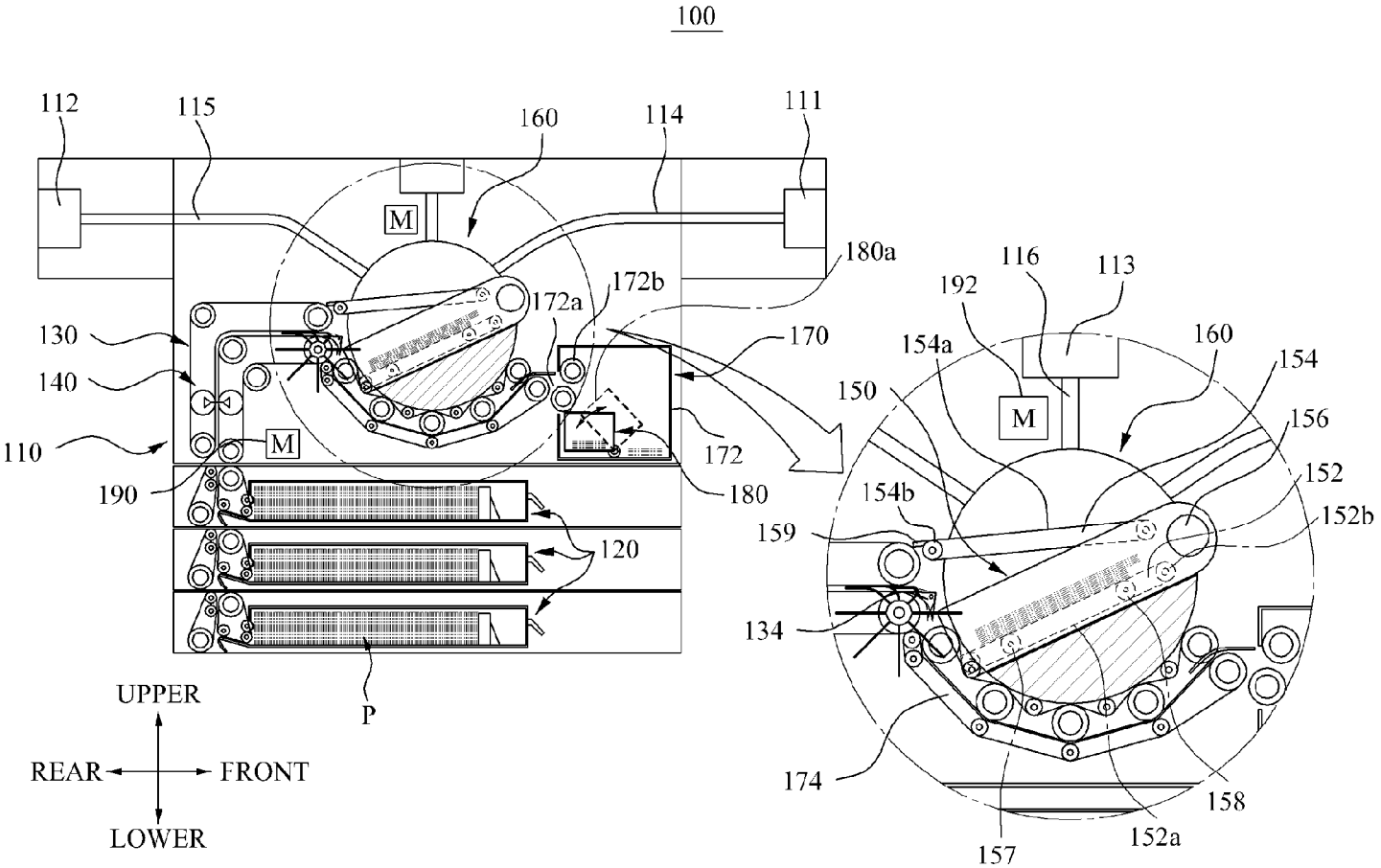
FIG. 1 is a structure view schematically illustrating an automatic teller machine (ATM) according to an embodiment of the present invention.

Reference will now be made in detail to embodiments of the present invention, examples of which are illustrated in the accompanying drawings, wherein like reference numerals refer to the like elements throughout. However, the scope of the present invention is not limited to the embodiments.

Figure 2:
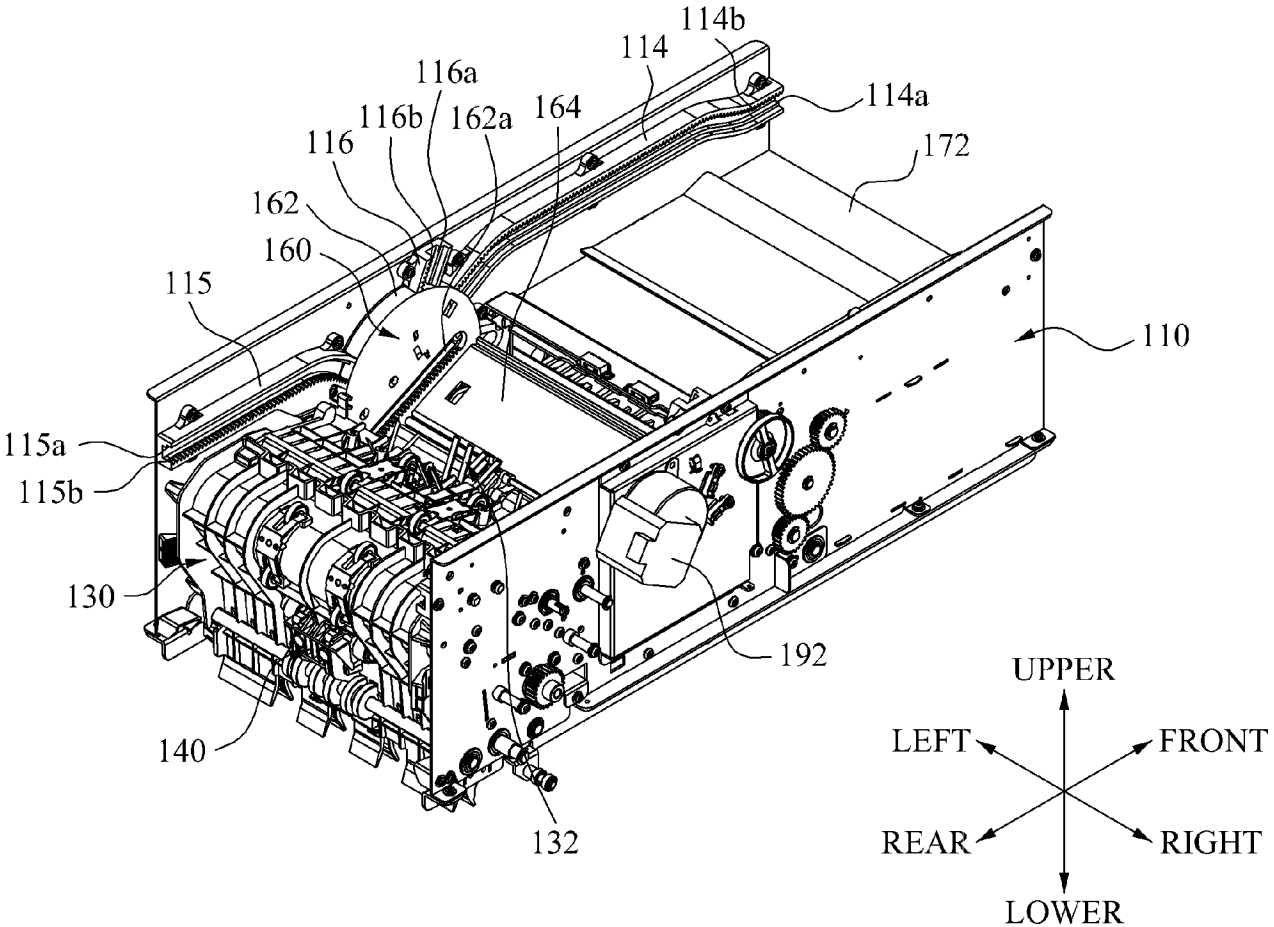
FIG. 2 is a perspective view illustrating main parts of the ATM of FIG. 1.
Figure 3:
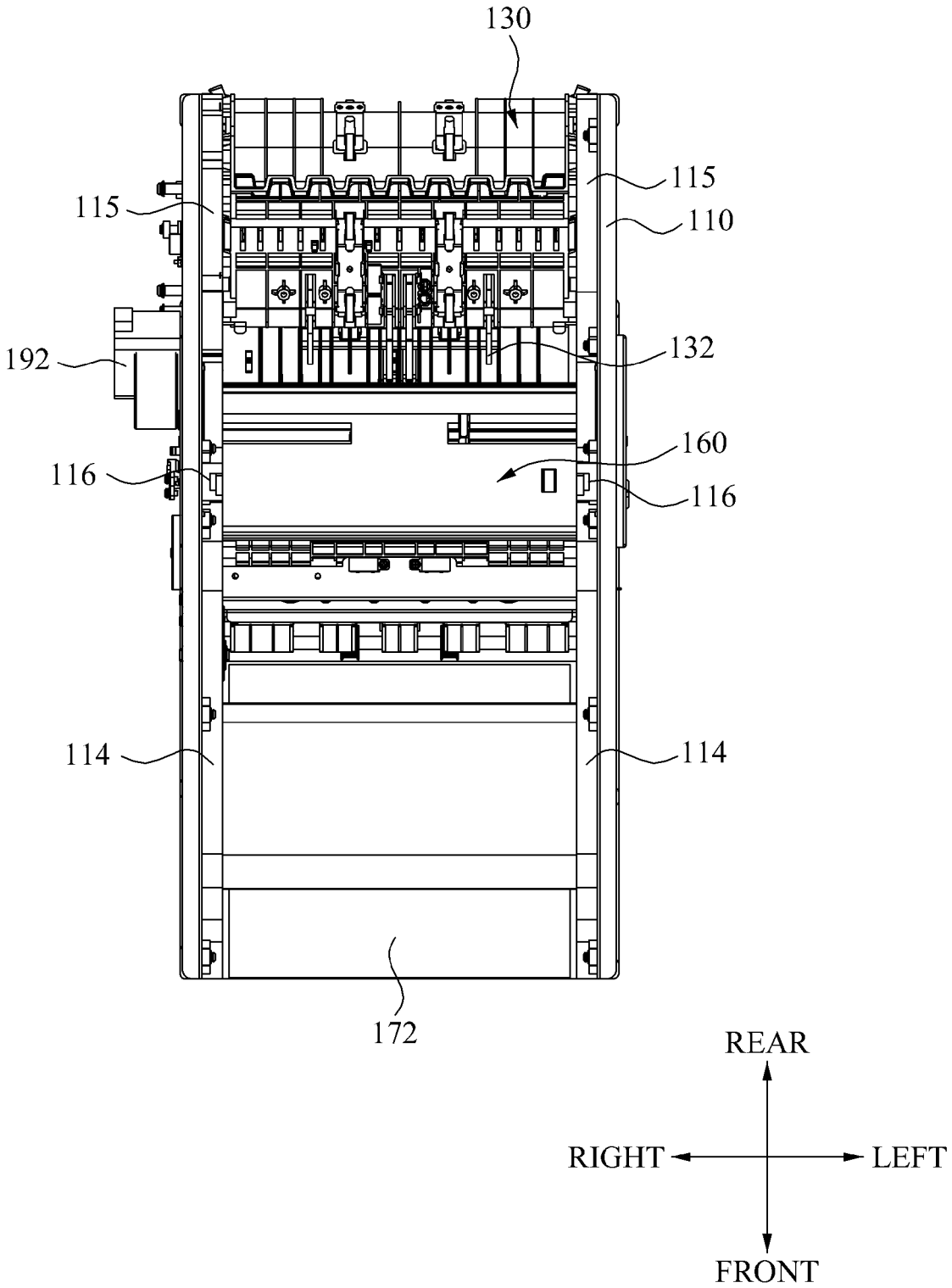
FIG. 3 is a plan view illustrating main parts of the ATM of FIG. 2.

FIG. 1 is a structure view schematically illustrating an automatic teller machine (ATM) 100 according to an embodiment of the present invention. FIG. 2 is a perspective view illustrating main parts of the ATM 100 of FIG. 1. FIG. 3 is a plan view illustrating main parts of the ATM 100 of FIG. 2. FIGS. 4 to 8 are views illustrating operational states of main parts of the ATM 100 shown in FIG. 2.

Referring to FIG. 1, the ATM 100 includes a case 110, a medium storage unit 120, a medium transfer unit 130, a medium inspection unit 140, a carriage 150, a rotor 160, and a medium collection unit 170. In the following description, the ATM 100 will be limitedly described as a cash dispenser. However, technical aspects of the present invention are applicable to a cash receiver and a combined cash receiver and dispenser.

The medium storage unit 120 may be disposed at a lower part of the case 110. The medium transfer unit 130, the medium inspection unit 140, the carriage 150, the rotor 160, the medium collection unit 170, dispenser portions 111, 112, and 113, and movement paths 114, 115, and 116 may be disposed at an upper part of the case 110.

The dispenser portions 111, 112, and 113 may be disposed in respectively different positions at the upper part of the case 110. That is, the dispenser portions 111, 112, and 113 may include a front dispenser 111 disposed at a front part of the case 110, a rear dispenser 112 disposed at a rear part of the case 110, and an upper dispenser 113 disposed at an upper surface of the case 110.

The movement paths 114, 115, and 116 may include a front movement path 114 disposed between the front dispenser 111 and the rotor 160, a rear movement path 115 disposed between the rear dispenser 112 and the rotor 160, and an upper movement path 116 disposed between the upper dispenser 113 and the rotor 160. However, the numbers and the positions of the dispenser portions 111, 112, and 113 and the movement paths 114, 115, and 116 are not specifically limited but may be varied according to the design and conditions of the ATM 100.

Referring to FIG. 2, the movement paths 114, 115, and 116 may respectively include guide rails 114*a*, 115*a*, and 116*a* disposed on opposite lateral sides of the case 110 to guide a movement direction of the carriage 150, and rail gears 114*b*, 115*b*, and 116*b* arranged in a length direction of the guide rails 114*a*, 115*a*, and 116*a*, respectively. A guide roller 157 of the carriage 150 may be movably inserted in the guide rails 114*a*, 115*a*, and 116*a*, which will be described later. The rail gears 114*b*, 115*b*, and 116*b* may be in the form of rack gears formed along the guide rails 114*a*, 115*a*, and 116*a*, and may be connected to a moving gear 158 of the carriage 150. The moving gear 158 will be described later.

Referring to FIG. 1, the medium storage unit 120 is adapted to store paper mediums P. Typically, the paper mediums P may include banknotes, checks, merchandise coupons, tickets, and the like. Hereinafter, the paper mediums P will be described as banknotes for convenience of explanation.

The medium storage unit 120 may be integrally formed with a lower part of the case 110. However, in the present embodiment, the medium storage unit 120 will be described to be removably mounted at the lower part of the case 110. For example, the medium storage unit 120 may be provided in the form of a removable box such as a cassette. The paper mediums P may be stored in the medium storage unit 120.

A plurality of the medium storage units 120 may be removably mounted at the lower part of the case 110. The same type or different types of the paper mediums P may be stored in the respective plurality of medium storage units 120.

Referring to FIGS. 1 and 2, the medium transfer unit 130 is adapted to selectively transfer the paper mediums P stored in any one of the plurality of medium storage units 120 sheet by sheet. The medium transfer unit 130 may be disposed between the medium storage unit 120 and the rotor 160. The medium transfer unit 130 may supply the paper mediums P into the carriage 150 disposed at the rotor 160. The medium transfer unit 130 may include a plurality of rollers and belts.

A sheet roller 132 may be disposed at an exit of the medium transfer unit 130 to feed the paper mediums P transferred by the medium transfer unit 130 sheet by sheet into the carriage 150.

Referring to FIGS. 1 and 2, the medium inspection unit 140 is adapted to detect whether the paper mediums P being transferred by the medium transfer unit 130 are in a normal state, in various methods. For example, the medium inspection unit 140 may use an ultrasonic sensor or a plurality of optical sensors.

In the following description of the present embodiment, the medium inspection unit 140 detects a change in thickness of the paper mediums P being transferred by the medium transfer unit 130, thereby determining whether a single sheet of the paper mediums P is transferred. For example, the medium inspection unit 140 may include two contact portions disposed in different positions, through which the paper mediums P are passed. A number of sheet of the paper mediums P may be detected by varying positions of the contact portions. In addition, the medium inspection unit 140 may include a plurality of contact portions disposed in respectively different positions to determine skew of the paper mediums P being transferred by the medium transfer unit 130.

Referring to FIG. 1, the carriage 150 is adapted to carry paper mediums P determined to be normal by the medium inspection unit 140 to the dispenser portions 111, 112, and 113. That is, the paper mediums P determined to be normal by the medium inspection unit 140 among the paper mediums P being transferred by the medium transfer unit 130 may be temporarily stacked in the carriage 150. When stacking of the paper mediums P in the carriage 150 is completed, the carriage 150 may be moved along any one of the movement paths 114, 115, and 116 and then dispense the paper mediums P through any one of the dispenser portions 111, 112, and 113. According to the present embodiment, the paper mediums P stacked in the carriage 150 are dispensed in a bundle.

The carriage 150 may include a first carriage portion 152, a second carriage portion 154, and a carriage driving portion 156.

The first carriage portion 152 may be provided in the form of a panel to tightly contact one surface of the paper medium P. When the carriage 150 is disposed inside the rotor 160, the first carriage portion 152 may be rotated along with the rotor 160 as the rotor 160 is rotated. During the operation of the medium transfer unit 130, the paper mediums P may be stacked on one surface of the first carriage portion 152. To move the stacked paper mediums P in a bundle, the first carriage portion 152 may include a first transfer belt 152*a* and a first transfer pulley 152*b* disposed at one side of the first carriage portion 152.

In addition, a guide roller 157 and a moving gear 158 may be disposed at opposite lateral sides of the first carriage portion 152, respectively. The guide roller 157 may be a roller member disposed in and moved along the guide rails 114*a*, 115*a*, and 116*a*. The moving gear 158 may be engaged with the rail gears 114*b*, 115*b*, and 116*b* and move along with the rail gears 114*b*, 115*b*, and 116*b* when rotated. The moving gear 158 may be a pinion gear rotated in engagement with the rail gears 114*b*, 115*b*, and 116*b* implemented by rack gears. Since the guide roller 157 and the moving gear 158 are separated from each other, being disposed at the opposite lateral sides of the first carriage portion 152, the carriage 150 may be stably supported by the guide roller 157 and the moving gear 158. In addition, the carriage 150 may be moved along the rail gears 114*b*, 115*b*, and 116*b* by the moving gear 158.

The second carriage portion 154 may be provided in the form of a panel to tightly contact the other surface of the paper mediums P. The second carriage portion 154 may be foldably connected to the carriage driving portion 156 to be in tight contact with the one surface of the first carriage portion 152. Therefore, one surface of the second carriage portion 154 may be brought into tight contact with the other surface of the paper mediums P stacked on the one surface of the first carriage portion 152. Here, the first carriage portion 152 and the second carriage portion 154 may include an elastic member (not shown) applying an elastic force in a direction for bringing the second carriage portion 154 into tight contact with the first carriage portion 152. The second carriage portion 154 may include a second transfer belt 154*a* and a second transfer pulley 154*b* disposed at one side of the second carriage portion 154 to move the paper mediums P stacked on the one surface of the first carriage portion 152 in a bundle. Here, the second transfer belt 154*a* and the first transfer belt 152*a* may be disposed to face each other.

An opening projection 159 may be formed at one side of the second carriage portion 154. The opening projection 135 is a member to restrict rotation of the second carriage portion 154 by being interfered with the case 110 or the medium transfer unit 130 when the rotor 160 rotates. That is, when the rotor 160 rotates along with the carriage 150 in a direction toward the medium transfer unit 130, the opening projection 135 may be interfered with the case 110 or the medium transfer unit 130, thereby restricting rotation of the second carriage portion 154. Therefore, even while the second carriage portion 154 is stopped by the opening projection 135, since the first carriage portion 152 may continue rotating along with the rotor 160, a gap between the first carriage portion 152 and the second carriage portion 154 may be widened by a rotational force of the rotor 160.

The carriage driving portion 156 may be connected with the first carriage portion 152 and the second carriage portion 154 to foldably support the first carriage portion 152 and the second carriage portion 154. That is, when the gap between the first carriage portion 152 and the second carriage portion 154 is widened, the paper mediums P transferred by the medium transfer unit 130 may be stacked on the one surface of the first carriage portion 152. Conversely, when the first carriage portion 152 and the second carriage portion 154 are folded to each other, the paper mediums P may be stably fixed in a bundle form between the one surface of the first carriage portion 152 and the one surface of the second carriage portion 154.

In addition, the carriage driving portion 156 may supply a driving force to the moving gear 158, the first transfer belt 152*a*, and the second transfer belt 154*a*. That is, the carriage driving portion 156 may include a first carriage driving portion (not shown) to drive the moving gear 158 in connection with the moving gear 158, and a second carriage driving portion (not shown) to drive the first transfer belt 152*a* and the second transfer belt 154*a* in connection with the first transfer pulley 152*b* and the second transfer pulley 154*b*. Therefore, when the first transfer belt 152*a* and the second transfer belt 154*a* are driven by the carriage driving portion 156 in a state where the first carriage portion 152 and the second carriage unit 154 are folded, the paper mediums P disposed between the first carriage portion 152 and the second carriage portion 154 may be withdrawn out of the carriage 150 by a predetermined length.

The carriage driving portion 156 may be connected to a controller (not shown) of the ATM 100 in various manners. Operations of the first carriage portion 152 and the second carriage portion 154 may be properly controlled by the controller. Various methods may be used to connect the carriage driving portion 156 and the controller according to the design and conditions of the ATM 100. For example, the carriage driving portion 156 may be connected to the controller by an elongated cable or elastic cable, or using the guide rails 114*a*, 115*a*, and 116*a* and the guide roller 157.

The rotor 160 may be disposed in the case 110 to be rotatable so as to convert a withdrawing direction of the carriage 150. That is, the carriage 150 may be withdrawably inserted in the rotor 160.

The rotor 160 may change a position of the carriage 150 to be directed to any one of the medium transfer unit 130, the front movement path 114, the rear movement path 115, the upper movement path 116, or a retract box 180 that will be described later. The rotor 160 may be rotated to any one of a first position, second positions, and a third position. In the first position, the paper mediums P are stacked in the carriage 150 by the medium transfer unit 130. In the second positions, the paper mediums P may be withdrawn to any one of the front movement path 114, the rear movement path 115, and the upper movement path 116. In the third position, the paper mediums P may be inserted in an entrance of the retract box 180 by the carriage 150.

Here, when the rotor 160 is in the first position, the first carriage portion 152 and the second carriage portion 154 may be separated from each other. That is, when the rotor 160 is rotated toward the first position, the opening projection 159 is interfered with the case 110 or the medium transfer unit 130, thereby restricting rotation of the second carriage portion 154. When the first rotor 160 is further rotated to the first position, the first carriage portion 152 continues rotating along with the rotor 160 while rotation of the second carriage portion 154 is restricted. Accordingly, the gap between the first carriage portion 152 and the second carriage portion 154 is widened, thereby forming a stacking space to stack the paper mediums P.

When the rotor 160 is disposed in other than the first position, the first carriage portion 152 and the second carriage portion 154 are folded to each other. That is, when the rotor 160 is rotated from the first position to other positions, the first carriage portion 152 may come into tight contact with the second carriage portion 154 and then the first carriage portion 152 and the second carriage portion 154 may be rotated in the folded state. As a result, the paper mediums stacked in the stacking space may be stably fixed.

The rotor 160 may include rotation portions 162 and a connecting portion 164. However, the rotor 160 may be configured in various forms according to the design and conditions of the ATM 100.

The rotation portions 162 may be rotatably mounted at opposite lateral sides of the case 110 and may be provided in a disc form. A carriage movement path 162*a* may be formed on an inner surface of each rotation portion 162 in the same shape as the movement paths 114, 115, and 116, to support the opposite lateral sides of the carriage 150. The guide roller 157 and the moving gear 158 formed at the opposite lateral sides of the carriage 150 may be disposed on the carriage movement path 162*a*. Also, the carriage movement path 162*a* may be opened toward an outer circumference of the rotation portion 162 so that the carriage 150 may be withdrawn out of the rotor 160. Therefore, when the rotor 160 is disposed in the second positions, the carriage movement path 162*a* is corresponded to any one of the front movement path 114, the upper movement path 116, and the rear movement path 115, thereby enabling movement of the carriage 150.

The connecting portion 164 is a plate member of which opposite sides are connected to the rotation portions 162 disposed at the opposite lateral sides of the case 110. Therefore, the rotation portions 162 disposed at the opposite lateral sides of the case 110 may be integrally rotated by the connecting portion 164. In addition, the carriage 150 disposed in the rotor 160 may be stably mounted.

Referring to FIG. 1, the medium collection unit 170 is adapted to collect paper mediums P determined to be abnormal by the medium inspection unit 140, along a path bypassing the carriage 150 and the rotor 160. The medium collection unit 170 may be disposed in the case 110.

The medium collection unit 170 may include a reject box 172 to receive the paper mediums P determined to be abnormal by the medium inspection unit 140, and a reject transfer portion 174 including a path bypassing the rotor 160 and the carriage 150 between the reject box 172 and the medium transfer unit 130 and transferring the paper mediums P to the reject box 172.

Accordingly, the paper mediums P determined to be abnormal by the medium inspection unit 140 may be not stacked in the carriage 150 but collected in the reject box 172 along the reject transfer portion 174. Since the operation of the medium transfer unit 130 is not stopped during this, stacking of the paper mediums P in the carriage 150 may be continued.

The reject box 172 refers to a box member configured to store a plurality of the paper mediums P determined to be abnormal by the medium inspection unit 130. An entrance of the reject box 172 may be directed to the rotor 160. Additionally, rotatable roller members 172*b* may be provided at the entrance 172*a* of the reject box 172 to guide the paper mediums P into the reject box 172.

The reject transfer portion 174 guides the paper mediums P determined to be abnormal by the medium inspection unit 140 into the reject box 172 from the medium transfer unit 130. The reject transfer portion 174 may be formed as a path bypassing the rotor 160 and the movement paths 114, 115, and 116 so as not to interfere with the operation of the rotor 160 and the carriage 150. The reject transfer portion 174 may include a belt and a pulley, in the same manner as the medium transfer unit 130. Hereinafter, the reject transfer portion 174 according to the embodiment will be described to be in a parabola shape concave down along a lower part of the rotor 160.

Referring to FIG. 1, a gate member 134 may be provided among an exit of the medium inspection unit 140, the rotor 160, and an entrance of the reject transfer portion 174 to guide the paper medium transferred by the medium transfer unit 130 to the carriage 150 disposed in the rotor 160 or to the reject transfer portion according to a detection value of the medium inspection unit 140. The gate member 134 may convert a transfer direction of the paper mediums P according to the detection value of the medium inspection unit 140. That is, when the gate member 134 is rotated in one direction, the paper mediums P transferred by the medium transfer unit 130 may be transferred to the carriage 150 disposed in the rotor 160. When the gate member 134 is rotated in another direction, the paper mediums P transferred by the medium transfer unit 130 may be transferred to the entrance of the reject transfer portion 174.

Referring to FIG. 1, the ATM 100 may further include the retract box 180 to store paper mediums P collected from the dispenser portions 111, 112, and 113 when the paper mediums P dispensed to the dispenser portions 111, 112, and 113 are not received. The retract box 180 may be disposed in the case 110 such that the entrance of the retract box 180 is directed to the rotor 160. In the present embodiment, the retracted box 180 is disposed in the reject box 172. Accordingly, space utilization of the case 110 may be further improved.

When the rotor 160 is rotated toward the entrance of the retract box 180 and disposed in the third position, the carriage 150 may be withdrawn to the entrance of the retract box 180. In addition, the paper mediums P may be inserted in the retract box 180 by the carriage 150.

The retract box 180 may be disposed in the reject box 172 to be movable or rotatable toward the entrance 172*a* of the reject box 172. That is, when the paper mediums P in a bundle not received by the dispenser portions 111, 112, and 113 are put in the entrance 172*a* of the reject box 172, the entrance 180*a* of the retract box 180 may be moved or rotated to the entrance 172*a* of the reject box 172. Therefore, the paper mediums P introduced through the entrance 172*a* of the reject box 172 may be stacked in the retract box 180. In the present embodiment, a lower part of the retract box 180 will be described to be rotatably hinged to a lower part of the reject box 172 and to be rotated about a hinge shaft by a separate driving portion (not shown).

Referring to FIG. 1, the ATM 100 may further include a main driving portion 190 disposed in the case 110 to provide a driving force to the medium transfer unit 130 and the medium collection unit 170. That is, the medium transfer unit 130, the reject transfer portion 174, and the reject roller 172*b* of the reject roller 172 may be driven together by the driving force of the main driving portion 190. Meanwhile, the rotor 160 may be controlled independently by a separate driving portion 192.

Hereinafter, the operational process of the above-structured ATM 100 will be described.

First, the medium transfer unit 130 receives a sheet of paper medium P from any one of the medium storage units 120 and transfers the sheet to the rotor 160. Here, the medium inspection unit 140 detects the paper medium P being transferred along the medium transfer unit 130 and determines whether the paper medium P is in a normal state. That is, the medium inspection unit 140 detects whether the paper medium P being transferred along the medium transfer unit 130 includes double sheets or is skewed. When the paper medium P includes double sheets or is skewed, the medium inspection unit 140 determines the paper medium P to be in an abnormal state.

Figure 4:
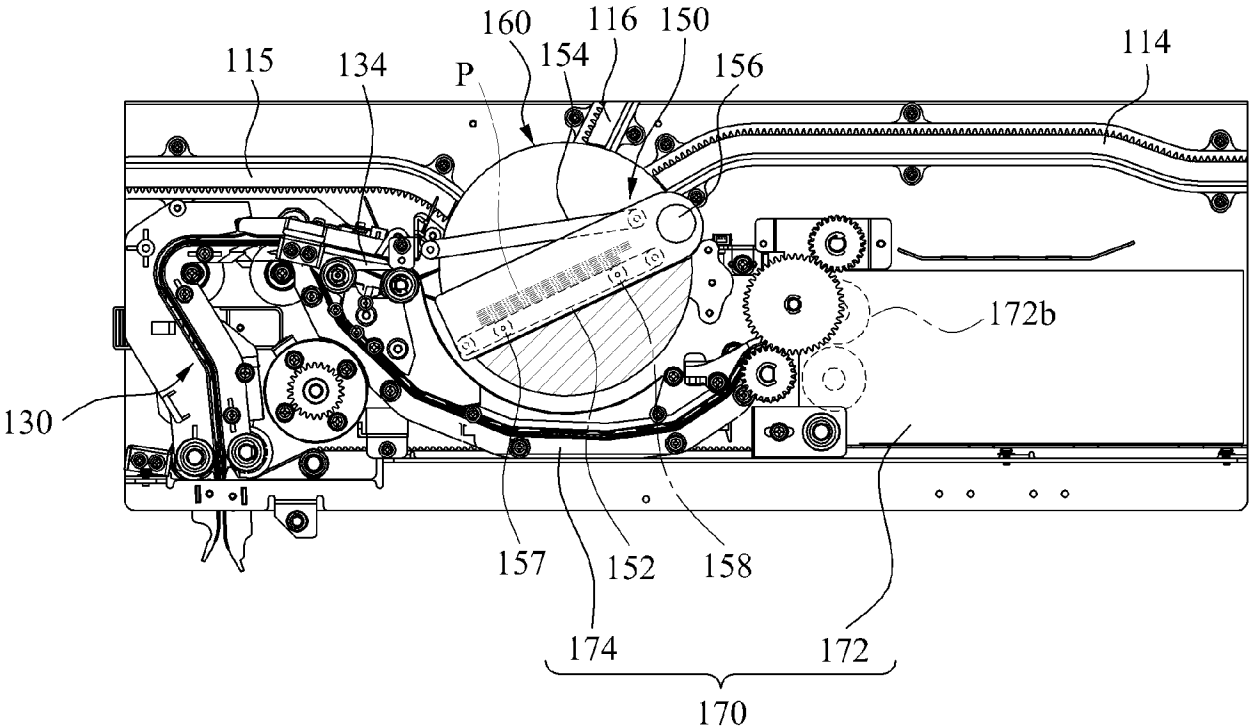
FIGS. 4 to 8 are views illustrating operational states of main parts of the ATM shown in FIG. 2.

Referring to FIG. 4, the rotor 160 rotates to the first position and disposes the carriage 150 to be directed to the exit of the medium transfer unit 130. When the rotor 160 is thus rotated, the opening projection 159 formed at the second carriage portion 154 of the medium transfer unit 130 is interfered with the medium transfer unit 130 or the case 110, thereby restricting rotation of the second carriage portion 154. However, in this state, since the first carriage portion 152 of the medium transfer unit 130 is still rotated along with the rotor 160, the first carriage portion 152 and the second carriage portion 154 are moved away from each other as the rotor 160 rotates, thereby forming a stacking space to stack the paper mediums.

When the paper medium P is determined to be normal by the medium inspection unit 140, the gate member 134 is operated in one direction, thereby guiding the paper medium P to the rotor 160. In this instance, the sheet roller 132 stacks the paper medium P in the stacking space of the carriage 150. Accordingly, a plurality of the paper mediums P may be vertically stacked in the carriage 150.

Figure 5:
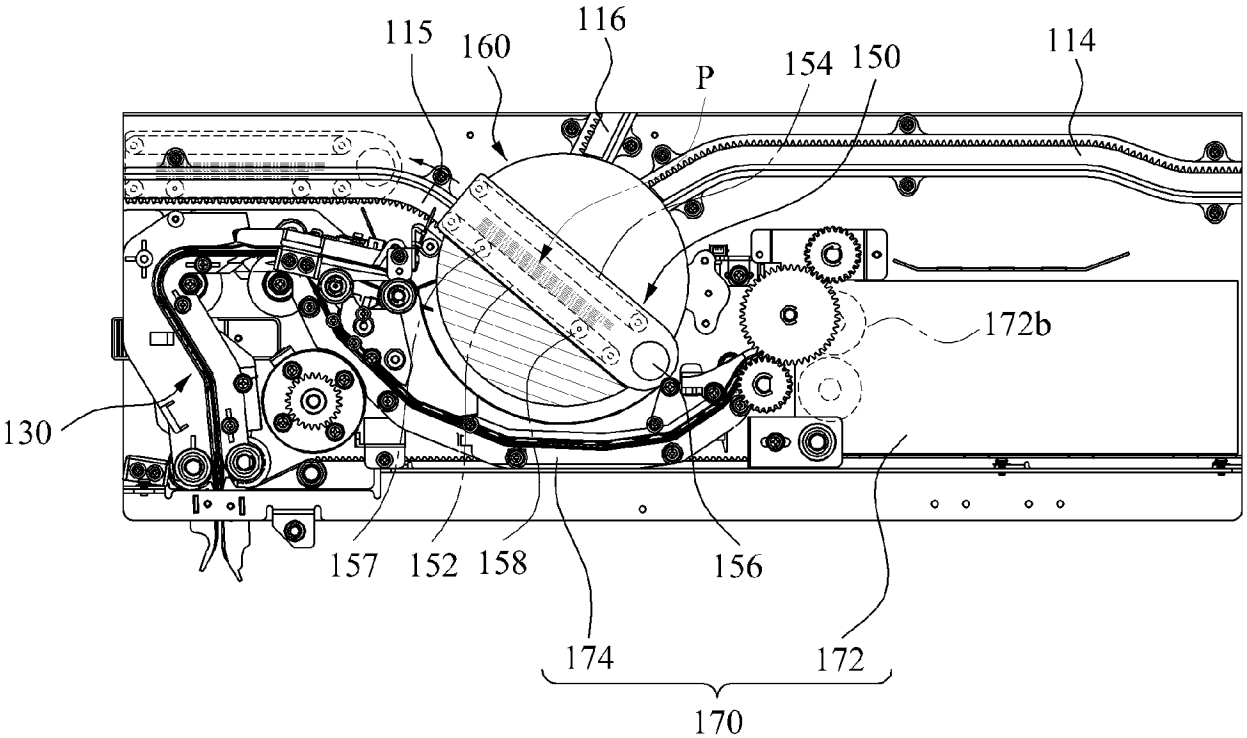
Figure 6:
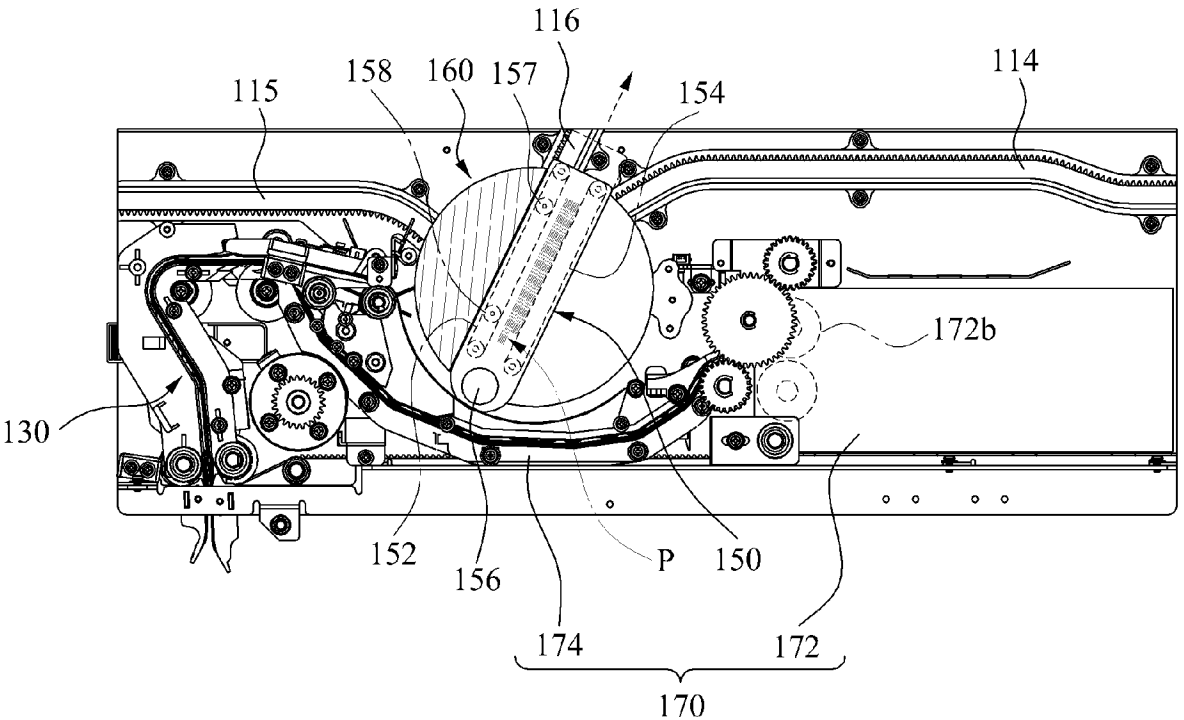
Figure 7:
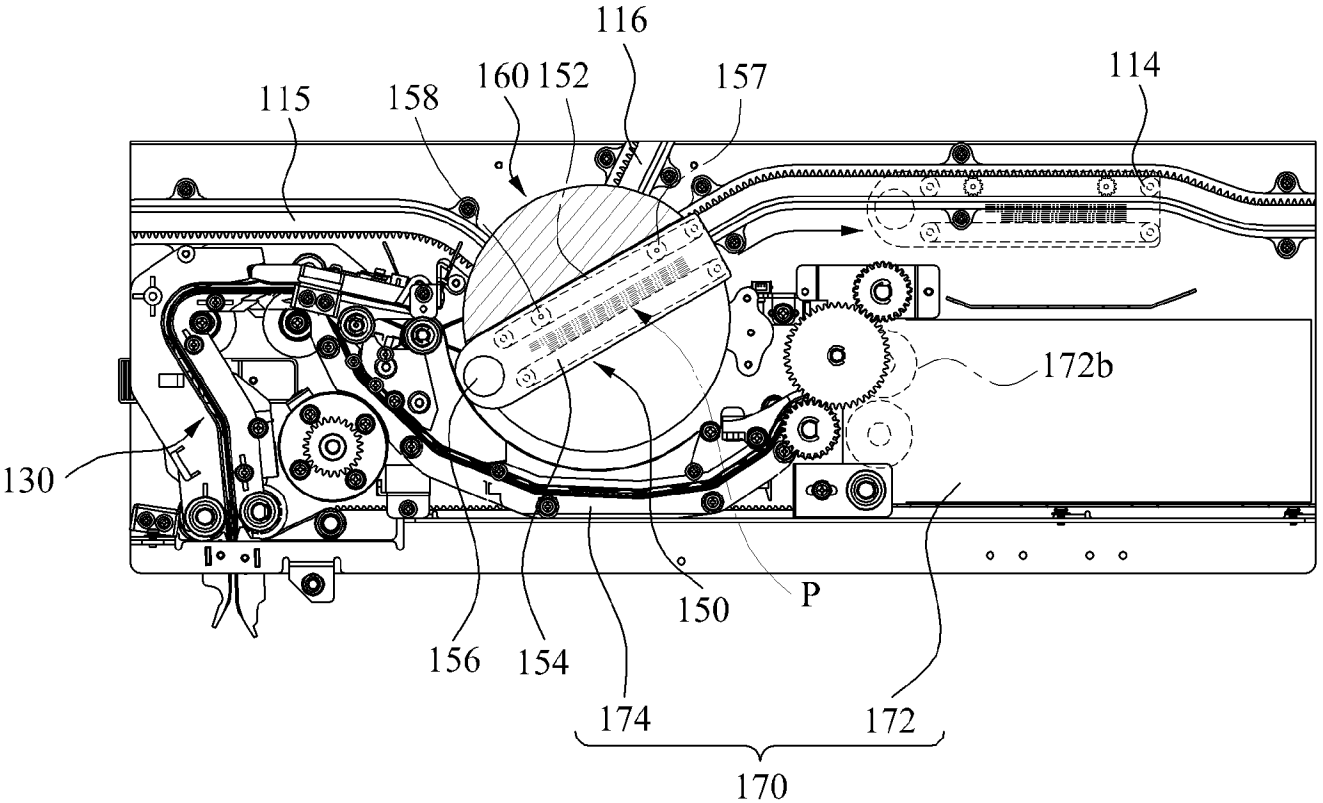

Referring to FIGS. 5 to 7, when a desired number of sheets of the paper mediums P are stacked in the carriage 150, the rotor 160 may be rotated from the first position to the second positions. In addition, the first carriage portion 152 rotated along with the rotor 160 may be folded to the second carriage portion 154. Accordingly, the paper mediums P in a bundle may be stably fixed by the first carriage portion 152 and the second carriage portion 154.

Next, the rotor 160 is rotated to one of the second positions according to positions of the dispenser portions 111, 112, and 113 through which the paper mediums P are to be dispensed.

As shown in FIG. 5, when the rotor 160 is rotated to a position where the carriage movement path 162*a* of the rotor 160 and the front movement path 114 fluidly communicate, the carriage 150 in the rotor 160 may be moved to the front dispenser portion 111 along the carriage movement path 162*a* and the front movement path 114. Also, the first transfer belt 152*a* and the second transfer belt 154*a* of the carriage 150 moved to the front dispenser portion 111 may be driven. Therefore, the paper mediums P are withdrawn to a front portion of the case 110 through the front dispenser portion 111.

As shown in FIG. 6, when the rotor 160 is rotated to a position where the carriage movement path 162*a* of the rotor 160 and the upper movement path 116 fluidly communicate, the carriage 150 in the rotor 160 is moved to the upper dispenser portion 113 along the carriage movement path 162*a* and the upper movement path 116. Also, the first transfer belt 152*a* and the second transfer belt 154*a* of the carriage 150 moved to the upper dispenser portion 113 may be driven. Therefore, the paper mediums P are withdrawn to an upper part of the case 110 through the upper dispenser portion 113.

As shown in FIG. 7, when the rotor 160 is rotated to a position where the carriage movement path 162*a* of the rotor 160 and the rear movement path 115 fluidly communicate, the carriage 150 in the rotor 160 is moved to the rear dispenser portion 112 along the carriage movement path 162*a* and the rear movement path 115. Also, the first transfer belt 152*a* and the second transfer belt 154*a* of the carriage 150 moved to the rear dispenser portion 112 may be driven. Therefore, the paper mediums P are withdrawn to a rear portion of the case 110 through the rear dispenser portion 112.

When the paper mediums P dispensed through the dispenser portions 111, 112, and 113 are not received by a customer, the first transfer belt 152*a* and the second transfer belt 154*a* of the carriage 150 are rotated backward to thereby collect the paper mediums p in a bundle into the carriage 150. In addition, the carriage 150 may return to the inside of the rotor 160 along the movement paths 114, 115, and 116 and the carriage movement path 162*a*.

Figure 8:
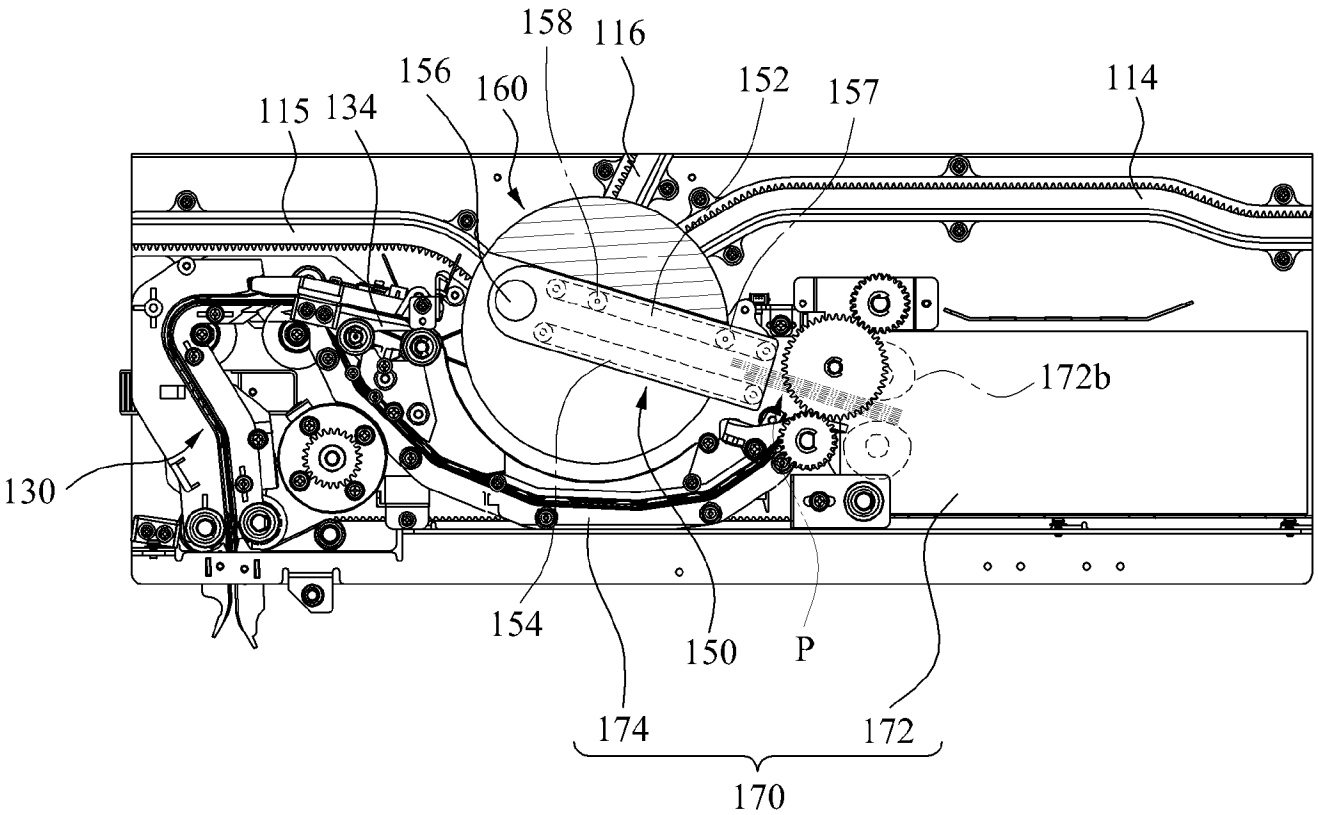

Referring to FIG. 8, the rotor 160 to which the carriage 150 returns is rotated to the third position. Accordingly, the carriage 150 may be disposed toward the entrance 162*a* of the reject box 172 of the medium collection unit 170. In addition, after the carriage 150 is withdrawn along the carriage movement path 162*a*, the first transfer belt 152*a* and the second transfer belt 154*a* of the carriage 150 are rotated forward, thereby inserting the paper mediums P in a bundle into the entrance 172*a* of the reject box 170.

In this instance, the retract box 180 may be rotated toward the entrance 172*a* of the reject box 172, and the reject roller 172*b* provided at the entrance 172*a* of the reject box 172 may be driven. Therefore, the reject roller 172*b* may collect the paper mediums P inserted in the entrance 172*a* of the reject box 172 and guide the paper mediums P to the entrance 180*a* of the retract box 180. When the paper mediums P are put into the retract box 180, the retract box 180 is returned to an initial position. In addition, the carriage 150 is returned into the rotor 160, and the rotor 160 is rotated to the first position.

When the paper mediums P are determined to be abnormal by the medium inspection unit 140, the gate member 134 is operated, thereby guiding the abnormal paper mediums P toward the reject transfer portion 174. Then, the reject transfer unit 174 transfers the abnormal paper mediums P to the entrance 172*a* of the reject box 172, and the reject roller 172*b* collects the paper mediums P transferred to the entrance 172*a* of the reject box 172 so that the paper mediums P are received in the reject box 172. Thus, the operation of collecting the paper mediums P determined to be abnormal into the reject box 172 may be independently performed from the operations of the carriage 150 and the rotor 160.

Figure 9:
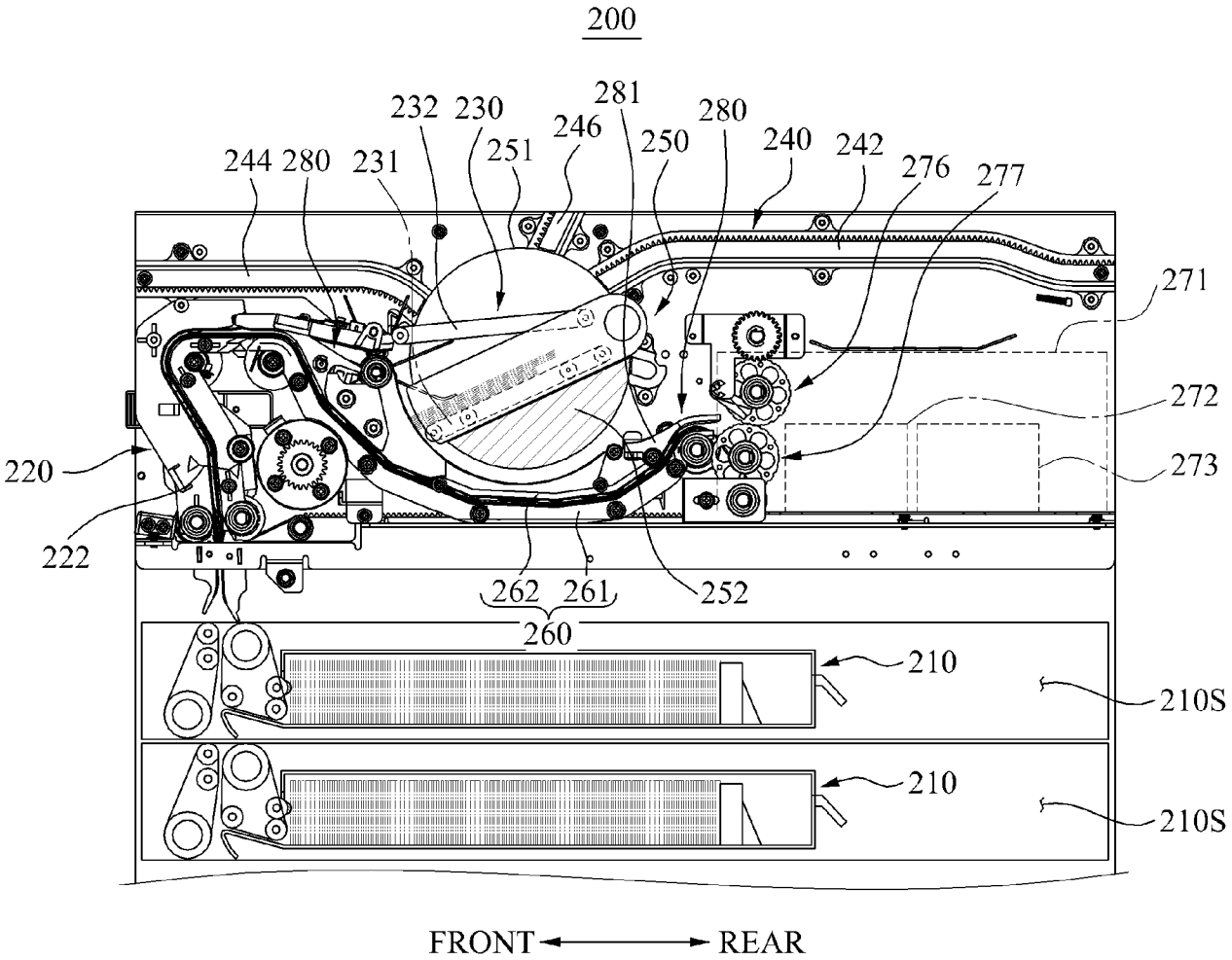
FIG. 9 is a view schematically illustrating an ATM according to another embodiment of the present invention.
Figure 10:
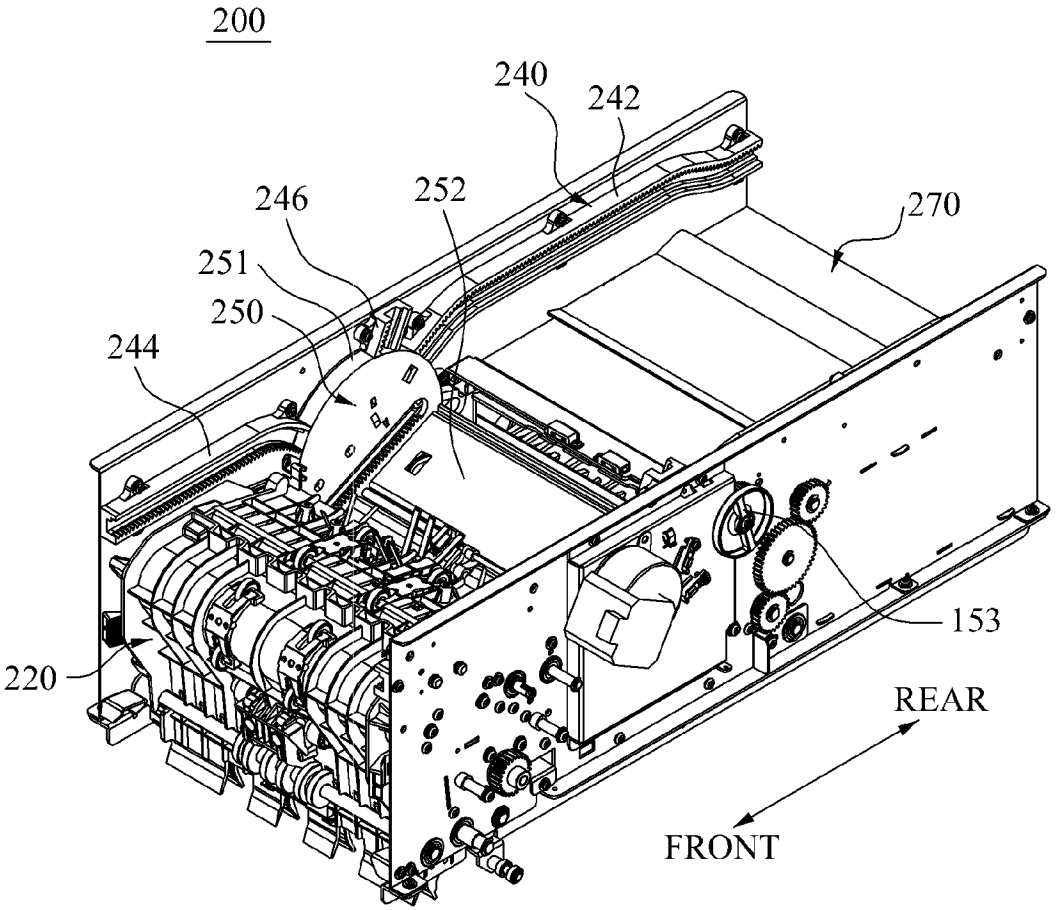
FIG. 10 is a perspective view partially illustrating an upper part of FIG. 9.
Figure 11:
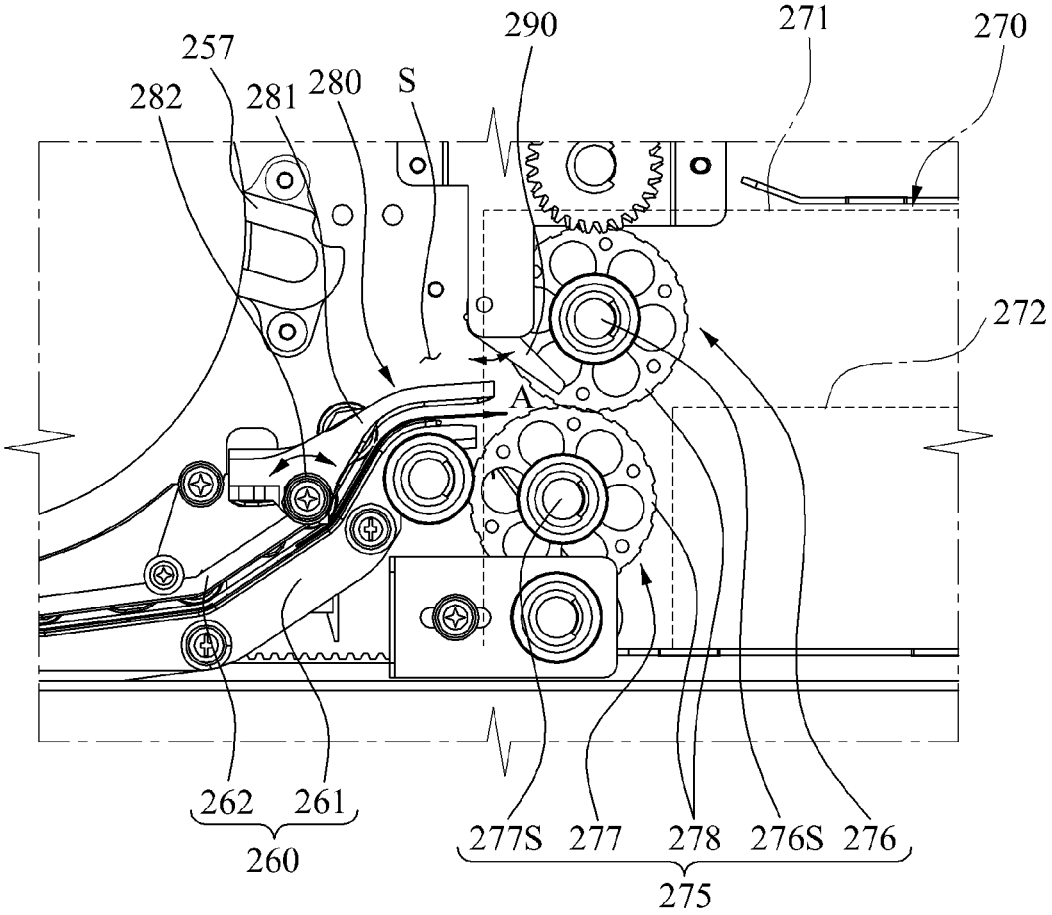
FIG. 11 is a view illustrating a state of a direction guide portion when a rejected paper medium is transferred from a rejected medium transfer portion to a collected medium storage portion shown in FIG. 9.
Figure 12:
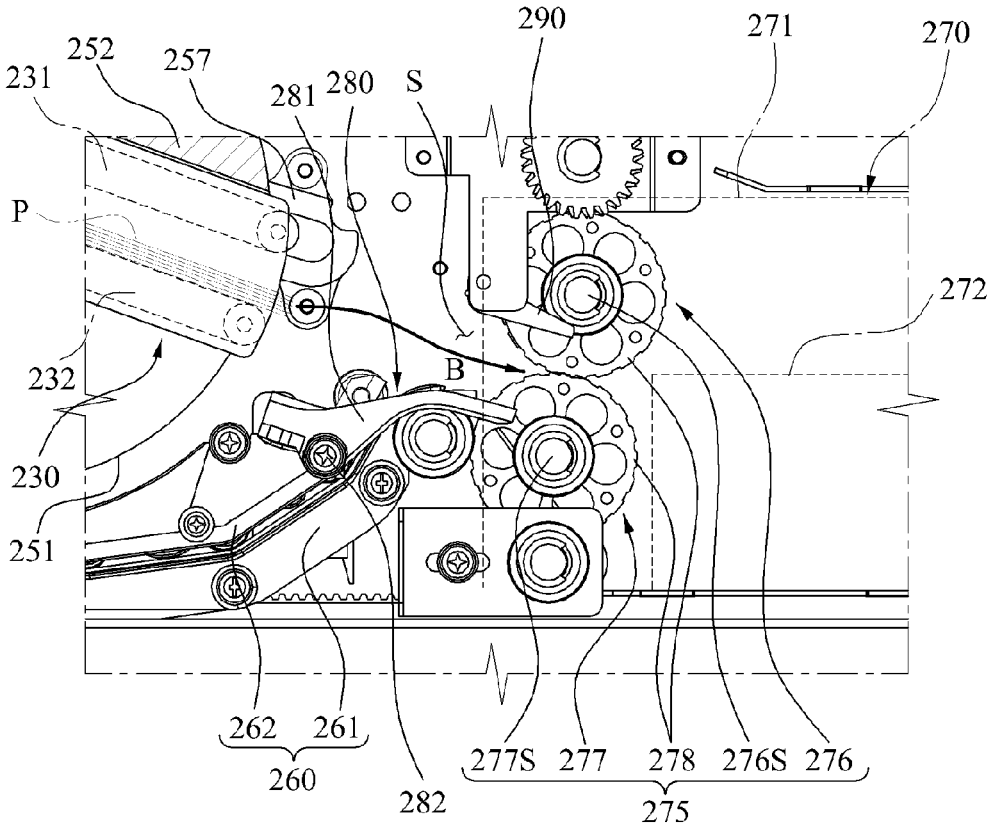
FIG. 12 is a view illustrating a state of the direction guide portion when a retracted paper medium is transferred from a carriage to the collected medium storage portion shown in FIG. 9.

FIG. 9 is a view schematically illustrating an ATM 200 according to another embodiment of the present invention. FIG. 10 is a perspective view partially illustrating an upper part of FIG. 9. FIG. 11 is a view illustrating a state of a direction guide portion 280 when a rejected paper medium is transferred from a rejected medium transfer portion 260 to a collected medium storage portion 270 shown in FIG. 9, and FIG. 12 is a view illustrating a state of the direction guide portion 280 when a retracted paper medium is transferred from a carriage to the collected medium storage portion 270 shown in FIG. 9.

Referring to FIGS. 9 and 10, the ATM 200 may include a medium storage portion 210 to store paper mediums P, a medium transfer portion 220 to transfer the paper mediums P supplied from the medium storage portion 210, a medium carrier 230 to carry the paper mediums P transferred by the medium transfer portion 220 to a dispenser portion (not shown), a carrier transfer portion 240 which forms a movement path for the medium carrier 230 to move to the dispenser portion, a carrier position adjustment portion 250 to adjust a position of the medium carrier 230, the rejected medium transfer portion 260 connected to a rear end of the medium transfer portion 220 to transfer a paper medium P detected to be abnormal during transfer along the medium transfer portion 220 and determined to be rejected, and the collected medium storage portion 270 disposed within a movement range of the medium carrier 230 to collect a paper medium P not received by the dispenser portion but refracted or collect the rejected paper medium P transferred along the rejected medium transfer portion 260.

According to the aforementioned structure, a normal paper medium, that is, the paper medium P not detected to be abnormal, may be transferred to the dispenser portion from the medium storage portion 210. Meanwhile, the paper medium P detected to be abnormal and rejected may be transferred to the collected medium storage portion 270 by the rejected medium transfer portion 260. Also, a paper medium P dispensed but not received, and therefore retracted, may be transferred to the collected medium storage portion 270. That is, the rejected paper medium P and the retracted paper medium P are transferred to and stored in the same storage place, that is, the collected medium storage portion 270. Therefore, the overall structure may be simplified while reducing an installation space and cost.

The respective parts will be described. The medium storage portion 210 may store the paper mediums P. The paper mediums P may include banknotes, checks, merchandise coupons, tickets, and the like. The medium storage portion 210 may be provided in the form of a cassette removably connected to a plurality of receiving spaces 210S arranged in a height direction in the ATM 200. Therefore, the paper mediums P may be stored in the medium storage portion 210. As the medium storage portion 210 is selectively connected to an inside of the ATM 200, the paper mediums P may be supplied to or withdrawn from the inside of the ATM 200.

The medium transfer portion 220 is adapted to transfer the paper mediums P stored in the medium storage portion 210 sheet by sheet. As shown in FIGS. 9 and 10, the medium transfer portion 220 may be disposed between the medium storage portion 210 and the carrier position adjustment portion 250, to feed the paper mediums P in the medium carrier 230 disposed at the carrier position adjustment portion 250. The medium transfer portion 220 may include a plurality of rollers and belts for transferring the paper mediums P. That is, as the rollers are rotated, the belts are circulated, thereby transferring the paper mediums P.

In addition, the medium transfer portion 220 may include a medium sensor 222 to detect whether the paper medium P being transferred from the medium storage portion 210 is a single sheet. That is, the medium sensor 222 may detect a thickness change of the paper mediums P being transferred by the medium transfer portion 220, thereby determining whether the paper medium P is a single sheet. In addition, a sheet roller (not shown) may be provided at an exit of the medium transfer portion 220 to feed the paper mediums P transferred by the medium transfer portion 220 sheet by sheet into the medium carrier 230.

The medium carrier 230 is adapted to stack and carry at least one sheet of the paper mediums P transferred by the medium transfer portion 220. A medium stacked in the medium carrier 230 may include a single sheet or plural sheets of the paper mediums P.

The medium carrier 230 may include a first carrier portion 231 and a second carrier portion 232 capable of moving toward or away from the first carrier portion 231. The first carrier portion 231 and the second carrier portion 232 are provided in a panel form. Since the second carrier portion 232 may approach the first carrier portion 231, the paper mediums P may be fixed within the first carrier portion 231 and the second carrier portion 232.

The above-structured medium carrier 230 may be transferred to the dispenser portion along the carrier transfer portion 240. The carrier transfer portion 240 may be formed between the dispenser portion and the carrier position adjustment portion 250 that will be described later. The carrier transfer portion 240 may include a rail structure to enable transfer of an entire part of the medium carrier 230.

Hereinafter, the ATM 200 according to the present embodiment will be described to include a plurality of the dispenser portions and accordingly include a plurality of the carrier transfer portions 240. For example, the dispenser portions are disposed at a front part, a rear part, and an upper part of the ATM 200. Accordingly, the carrier transfer portions 240 may include a front carrier transfer portion 242 connected to the dispenser portion provided at the front part, a rear carrier transfer portion 244 connected to the dispenser portion provided at the rear part, and an upper carrier transfer portion 246 connected to the dispenser portion provided at the upper part.

The carrier position adjustment 250 may change the position of the medium carrier 230 as shown in FIG. 9. That is, the carrier position adjustment 250 may rotate the medium carrier 230, thereby changing the position of the medium carrier 230 so that an open portion of the medium carrier 230 is directed to any one of the exit of the medium transfer portion 220, an entrance of the front carrier transfer portion 242, an entrance of the rear carrier transfer portion 244, an entrance of the upper carrier transfer portion 246, and an entrance of the collected medium storage portion 270 that will be described later.

Furthermore, the carrier position adjustment portion 250 may transfer the medium carrier 230 along the carrier transfer portions 240 as well as changing the position of the medium carrier 230 in a rotating manner. Therefore, the medium carrier 230 may be transferred to the respective dispenser portions and accordingly supply the paper mediums P in the medium carrier 230 to the dispenser portions.

The structure of the carrier position adjustment portion 250 will be further described. As shown in FIG. 9, the carrier position adjustment portion 250 may include a plate 252 to which the medium carrier 230 may be mounted. Also, the carrier position adjustment portion 250 may include a rotor 251 rotatable along with the medium carrier 230 and a rotor driving portion (not shown) to drive the rotor 251. According to the foregoing structure, the carrier position adjustment portion 250 may adjust the position.

As aforementioned, according to related arts, a storage portion to store rejected paper medium and a storage portion to store retracted paper medium are separately formed, thereby complicating the structure and increasing the installation space and cost.

Therefore, to remove such limits of the related arts, the ATM 200 may include one collected medium storage portion 270, the rejected medium transfer portion 260 disposed between the medium transfer portion 220 and the collected medium storage portion 270 to transfer the paper mediums P detected to be abnormal during transfer along the medium transfer portion 220 and determined to be rejected, to the collected medium storage portion 270, and the direction guide portion 280 disposed at a rear end of the rejected medium transfer portion 260 to transfer the rejected paper medium P to a collected medium or the retracted paper medium P transferred by the medium carrier to the collected medium storage portion 270.

According to the foregoing structure, a discharge path for the paper medium P being discharged from the rejected medium transfer portion 260 to the collected medium storage portion 270 and a discharge path for the paper medium P being discharged from the medium carrier 230 to the collected medium storage portion 270 are formed in a common discharge space S. Therefore, not only the rejected paper medium P but also the retracted paper medium P may be stored in one place, that is, the collected medium storage portion 270. Consequently, the structure may be simplified while the installation space and the cost are also reduced.

The respective parts will be described. First, the collected medium storage portion 270 is adapted to collect the paper mediums P dispensed by the dispenser portions but not received, and therefore retracted, or the paper mediums P determined to be rejected during transfer along the medium transfer portion 220. The collected medium storage portion 270 may be a cassette type to be easily connected to and detached from the ATM 200.

As schematically shown in FIG. 9, the collected medium storage portion 270 may include a collecting case 271, a retracted medium storage box 272 disposed at a front end of the collecting case 271 to store the retracted paper medium P, a rejected medium storage box 273 disposed at a rear end of the retracted medium storage box 272 to store the rejected paper medium P, and a rotation roller unit 275 disposed at an entrance of the collecting case 271 to introduce the rejected or retracted paper medium P into the collecting case 271.

First, the collecting case 271 may have a box shape and include the entrance in a position facing a rear end of the rejected medium transfer portion 260 and the carrier position adjustment portion 250. The collecting case 271 may have a locking structure so that only an authorized user may open and close.

In the present embodiment, the retracted medium storage box 272 and the rejected medium storage box 273 may be separately provided within the collecting case 271. Therefore, the respective paper mediums P may be introduced and stored in the respective spaces. However, not limited to the foregoing structure, the retracted medium storage box 272 and the rejected medium storage box 273 may be integrally formed and commonly used.

The rotation roller unit 275 is adapted to transfer the rejected or refracted paper medium P into the collecting case 271 by rotating.

As shown in FIG. 9 in detail, the rotation roller unit 275 may include an upper roller portion 276 which includes a driving gear (not shown) rotated by a driving force supplied from the outside and a plurality of rotation rollers 278 arranged in a length direction of a rotational axis 276S, and a lower roller portion 277 which includes a driven gear (not shown) meshed with the driving gear of the upper roller portion 276 and a plurality of rotation rollers 278 arranged in a length direction of a rotational axis 277S.

According to the foregoing structure, as shown in FIGS. 11 and 12, when the driving gear of the upper roller portion 276 rotates counterclockwise, the driven gear of the lower roller portion 277 is rotated clockwise. Therefore, the rejected or retracted paper medium P may be passed through the entrance of the collecting case 271 and introduced into the collecting case 271.

Here, the rotation rollers 278 of the upper roller portion 276 and the rotation rollers 278 of the lower roller portion 277 may be substantially the same. The rotation rollers 278 may be made of an elastic material contractible inward as the plurality of paper mediums P are introduced and deformable to press the paper mediums P.

The rejected medium transfer portion 260 may be connected to the medium transfer portion 220 with one end and connected to the entrance of the collected medium storage portion 270 with a rear end, as shown in FIG. 9. Accordingly, the paper mediums P transferred from the medium transfer portion 220 may be passed through the rejected medium transfer portion 260 and stored in the collected medium storage portion 270.

In addition, the rejected medium transfer portion 260 may be disposed at a lower part of the carrier position adjustment portion 250. Therefore, although the paper mediums P are jammed in a transfer path of the rejected medium transfer portion 260, removal of the paper mediums P may be easily achieved.

The structure of the rejected medium transfer portion 260 will be described in further detail. As shown in FIG. 9, the rejected medium transfer portion 260 may include a lower conveying portion 261 in a conveyer form which is connected to the rear end of the medium transfer portion 220 with one end, and connected to a position adjacent to the collected medium storage portion 270 with the other end, and an upper conveying portion 262 disposed at an upper part of the lower conveying portion 261.

By the aforementioned structure, the paper mediums P introduced between the upper conveying portion 262 and the lower conveying portion 261 may be smoothly moved and introduced into the collected medium storage portion 270.

However, as aforementioned, a jam of the paper mediums P may occur during transfer of the paper mediums P along the rejected medium transfer portion 260.

To solve this, the upper conveying portion 262 may have a width smaller than a width of the lower conveying portion 261. More specifically, the width of the upper conveying portion 262 is smaller than the width of the lower conveying portion 261 and also smaller than a width of the paper mediums P.

Therefore, although the paper mediums P are jammed, access to the paper mediums P jammed in the upper conveying portion 262 and the lower conveying portion 261 may be enabled by adjusting the position of the carrier position adjustment portion 250. Thus, the paper mediums P jammed in the upper conveying portion 262 and the lower conveying portion 261 may be easily removed.

As shown in FIGS. 11 and 12, the direction guide portion 280 may be disposed to be rotatable at the rear end of the rejected medium transfer portion 260, so as to guide an advancing direction of the paper mediums P.

As shown in FIGS. 11 and 12, the direction guide portion 280 may include a guide body 281 rotatably connected at a rear end area of the rejected medium transfer portion 260 to guide the advancing direction of the paper mediums P, and a rotational axis 282 to enable axial rotation of the guide body 281.

The guide body 281 may include a curve surface corresponding to a rear end of the lower conveying portion 261 of the rejected medium transfer portion 260, as shown in FIG. 11. A lower surface of the guide body 281 may guide the paper mediums P in an arrowed direction A in FIG. 11 when the paper mediums P are transferred from the rejected medium transfer portion 260 to the collected medium storage portion 270. An upper surface of the guide body 281 guides the paper mediums P in an arrowed direction B in FIG. 12 when the paper mediums P are transferred from the medium carrier 230 to the collected medium storage portion 270.

The guide body 281 adjusts its position between a reject discharge position forming a transfer path connecting the rejected medium transfer portion 260 to the entrance of the collected medium storage portion 270 (the position of the guide body 281 in FIG. 11) and a retract discharge position forming a transfer path connecting the medium carrier 230 to the entrance of the collected medium storage portion 270 (the position of the guide body 281 in FIG. 12).

For example, when the paper mediums P are transferred along the rejected medium transfer portion 260, the guide body 281 is pressed by the paper mediums P, thereby forming the transfer path connecting the rejected medium transfer portion 260 to the collected medium storage portion 270 as shown in FIG. 11. Therefore, the paper mediums P may be introduced into the collected medium storage portion 270 along the transfer path.

Conversely, when the paper mediums P not received by the dispenser portions but retracted are discharged from the medium carrier 230 and presses the guide body 281, the guide body 281 may be rotated to the retract discharge position as shown in FIG. 12, accordingly forming the transfer path for the paper mediums P being transferred from the medium carrier 230 to the collected medium storage portion 270. Here, when the guide body 281 is disposed in the retract discharge position, the guide body 281 may prevent escape of the paper mediums P while guiding transfer of the paper mediums P.

In the present embodiment, to increase accessibility of the medium carrier 230 with respect to the collected medium storage portion 270 when the paper mediums P are discharged from the medium carrier 230 to the collected medium storage portion 270, the carrier position adjustment portion 250 may further include a carrier guide 257 directed to the entrance of the collected medium storage portion 270 as shown in FIGS. 11 and 12.

The medium carrier 230 holding the refracted paper medium P may be rotated by operating the carrier position adjustment portion 250 and then moved toward the collected medium storage portion 270 along the carrier guide 257, thereby accessing the collected medium storage portion 270. Accordingly, the paper mediums P discharged from the medium carrier 230 may be smoothly introduced into the inner space of the collected medium storage portion 270 through the rotation roller unit 275 mounted at the entrance of the collected medium storage portion 270.

In addition, referring to FIGS. 11 and 12, rotation guides 290 rotating in respective original positions are arranged at the entrance area of the collected medium storage portion 270, more specifically, between the rotation rollers 278 of the upper roller portion 276.

The rotation guides 290 may be operated in association with the guide body 281. For example, when the guide body 281 is disposed in the reject discharge position so as to discharge the paper mediums P from the rejected medium transfer portion 260 to the collected medium storage portion 270, the rotation guides 290 may be maintained in a state of being pivoted down as shown in FIG. 11. Accordingly, the paper mediums P discharged from the rejected medium transfer portion 260 to the entrance of the collected medium storage portion 270 may be slightly collided with the rotation guide 290 and then introduced into the rotation roller unit 275. That is, the rotation guides 290 may prevent escape of the paper mediums P while guiding transfer of the rejected paper medium P being introduced into the collected medium storage portion 270.

Conversely, when the guide body 281 is disposed in the retract discharge position so as to discharge the paper mediums P from the medium carrier 230 to the collected medium storage portion 270, the rotation guides 290 may be maintained in a state of being pivoted up as shown in FIG. 12, thereby guiding transfer of the paper mediums P from the medium carrier 230 to the entrance of the collected medium storage portion 270.

Hereinafter, the operation of the ATM 200 structured as aforementioned will be described.

First, the paper mediums P are fed sheet by sheet from the medium storage portion 210 to the medium transfer portion 220, and the medium transfer portion 220 transfers the paper mediums P to the medium carrier 230. In this instance, the medium sensor 222 may detect whether the paper mediums P are in a normal or abnormal state. The paper medium P detected to be abnormal and determined to be rejected may be transferred to the collected medium storage portion 270 along the rejected medium transfer portion 260.

Here, when the paper mediums P are transferred from the rejected medium transfer portion 260 to the collected medium storage portion 270, the direction guide portion 280 mounted to the rear end of the rejected medium transfer portion 260 may be disposed in the reject discharge position, that is, the position of the guide body 281 as shown in FIG. 11. Therefore, the rejected paper medium P may be smoothly introduced from the reject medium transfer portion 260 to the collected medium storage portion 270.

The paper medium P detected to be normal by the medium sensor 222 may be carried to the medium carrier 230 and supplied to the dispenser portions by the carrier position adjustment portion 250. Here, the paper medium P supplied to the dispenser portions may be not received but retracted. In this case, the retracted paper medium P may be carried by the medium carrier 230 and transferred to the collected medium storage portion 270.

Here, when the paper mediums P are transferred from the medium carrier 230 to the collected medium storage portion 270, the direction guide portion 280 may be disposed in the retract discharge position, that is, the position of the guide body 281 as shown in FIG. 12. Therefore, the retracted paper medium P may be smoothly introduced from the medium carrier 230 into the collected medium storage portion 270.

Thus, according to the present embodiment, the paper medium P detected to be abnormal during transfer along the medium transfer portion 220 and determined to be rejected and the paper medium P not received by the dispenser portion but retracted may be collected to one space, that is, the collected medium storage portion 270. As a result, the overall structure may be simplified, thereby reducing the size and cost of the apparatus.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

The invention claimed is:

1. An automatic teller machine (ATM) comprising:

a case in which a plurality of dispenser portions are disposed in different positions;

a medium storage unit provided to the case to store paper mediums;

a medium transfer unit to transfer the paper mediums sheet by sheet from the medium storage unit;

a medium inspection unit provided to the medium transfer unit to detect the paper mediums being transferred by the medium transfer unit;

a carriage in which paper mediums determined to be normal by the medium inspection unit are stacked, the carriage configured to be transferred along any one of movement paths connected to the plurality of dispenser portions to dispense the paper mediums through any one of the plurality of dispenser portions;

a rotor in which the carriage is withdrawably inserted, the rotor rotatably mounted in the case and rotated along with the carriage in any position between a first position in which the paper mediums are stacked in the carriage and a second position in which the carriage is moved to the movement paths; and a medium collection unit disposed in the case such that paper mediums determined to be abnormal by the medium inspection unit are collected along a path bypassing the carriage and the rotor.

2. The ATM of claim 1, wherein the plurality of dispenser portions comprises a front dispenser portion disposed on a front portion of the case, a rear dispenser disposed at a rear portion of the case, and an upper dispenser disposed at an upper surface of the case, and the movement paths comprises a front movement path disposed between the front dispenser and the rotor, a rear movement path disposed between the rear dispenser and the rotor, and an upper movement path disposed between the upper dispenser and the rotor.

3. The ATM of claim 1, wherein the movement paths each comprise guide rails disposed on opposite lateral sides of the case to guide a movement direction of the carriage, and rail gears arranged in a length direction of the guide rails, and the carriage comprises guide rollers disposed on opposite lateral sides to be moved along the guide rails, respectively, and moving gears disposed on the opposite lateral sides to be engaged with and moved along the rail gears, respectively.

4. The ATM of claim 3, wherein the carriage comprises:

a first carriage portion provided with the guide rollers and the moving gears disposed on the opposite lateral sides, and rotated along with the rotor when the rotor rotates;

a second carriage portion disposed to face the first carriage portion such that the paper mediums are disposed between the first carriage portion and the second carriage portion; and a carriage driving portion to which the first carriage portion and the second carriage portion are foldably connected, the carriage driving portion configured to drive the moving gear.

5. The ATM of claim 4, wherein the first carriage portion comprises a first transfer belt tightly contacting one surface of the paper mediums, the second carriage portion comprises a second transfer belt tightly contacting the other surface of the paper mediums, and the first transfer belt and the second transfer belt are driven by the carriage driving portion.

6. The ATM of claim 5, wherein the carriage driving portion comprises:

a first carriage driving portion connected to the moving gear to drive the moving gear; and a second carriage driving portion connected to the first transfer belt and the second transfer belt to drive the first transfer belt and the second transfer belt.

7. The ATM of claim 3, wherein the first carriage portion and the second carriage portion are moved away from each other, thereby forming a stacking space to stack the paper mediums, when the rotor is disposed in the first position, and the first carriage portion and the second carriage portion are folded to each other, thereby fixing the paper mediums stacked in the stacking space, when the rotor is disposed in other than the first position.

8. The ATM of claim 7, wherein the second carriage portion comprises an opening projection configured to be interfered with the case or the medium transfer unit such that the first carriage portion and the second carriage portion are separated from each other when the rotor rotates to the first position, thereby restricting rotation of the second carriage portion.

9. The ATM of claim 1, wherein the rotor comprises:

rotation portions rotatably disposed on opposite lateral sides of the case so as to support movement of opposite lateral sides of the carriage; and a connecting portion of which opposite sides are connected to the rotation portions and in which the carriage is mounted.

10. An automatic teller machine (ATM) comprising:

a rejected medium transfer portion connected to a medium transfer unit that transfers paper mediums from a medium storage unit, the medium storage unit storing the paper mediums to transfer a rejected paper medium detected to be abnormal during transfer of the paper mediums along the medium transfer unit;

a carrier position adjustment portion configured to rotate a medium carrier for transferring a refracted medium uncollected at a dispenser portion by a user so that an open portion of the medium carrier faces discharge space; and a collected medium storage portion configured to receive the rejected paper medium and the retracted medium via the discharge space, the collected storage disposed at a rear end of the rejected medium transfer portion to store the rejected paper medium and the retracted paper medium.

11. The ATM of claim 10, further comprising:

a direction guide portion disposed at a rear end of the rejected medium transfer portion disposed adjacent to the discharge space to be rotatable in an up and down direction to selectively guide an advancing direction of the paper mediums, wherein the direction guide portion transfers the paper mediums transferred by the rejected medium transfer portion to the collected medium storage portion, or transfers the paper mediums transferred by the medium carrier to the collected medium storage portion.

12. The ATM of claim 11, wherein the direction guide portion comprises a guide body and a rotational axis for axially rotating the guide body, and the guide body is direction-converted by a pressing force of the paper mediums approaching the guide body.

13. The ATM of claim 10, wherein the carrier position adjustment portion comprises a carrier guide disposed between an entrance of the collected medium storage portion and the carrier position adjustment portion so that the medium carrier approaches the entrance when the paper mediums are retracted.

14. The ATM of claim 10, wherein a rotation roller unit is mounted at an entrance area of the collected medium storage portion to introduce the paper mediums to an inner space of the collected medium storage portion, wherein the rotation roller unit comprises:

an upper roller portion comprising a rotational axis axially rotated by a driving source and a plurality of rollers arranged in a length direction of the rotational axis; and a lower roller portion comprising a rotational axis rotated in an opposite direction to rotation of the rotational axis of the upper roller portion and a plurality of rollers arranged in a length direction of the rotational axis of the lower roller portion, and wherein the pluralities of rollers are made of an elastic material elastically deformable in an inward direction.

15. The ATM of claim 14, wherein the entrance area of the collected medium storage portion comprises a rotation guide freely rotated according to an advancing direction of the paper mediums to guide the paper mediums discharged from the rejected medium transfer portion or the medium carrier into the rotation roller unit.

* * * * *